United States Patent [19]

Lanner

[11] 4,233,089

[45] Nov. 11, 1980

[54] LOW-ALLOYED STEEL FOR THE PREPARATION OF VALVE SPRING WIRE

[75] Inventor: Christer Lanner, Garphyttan, Sweden

[73] Assignee: Aktiebolaget Garphytte Bruk, Garphytte, Sweden

[21] Appl. No.: 959,617

[22] Filed: Nov. 13, 1978

Related U.S. Application Data

[63] Continuation of Ser. No. 835,281, Sep. 20, 1977, abandoned.

[30] Foreign Application Priority Data

Sep. 20, 1976 [SE] Sweden ..... 7610405

[51] Int. Cl.[3] ..... C22C 38/06

[52] U.S. Cl. ..... 148/36; 75/124; 148/12 B

[58] Field of Search ..... 148/36, 12 B; 75/129, 75/123 BN

[56] References Cited

U.S. PATENT DOCUMENTS

| | | | |
|---|---|---|---|
| 2,229,140 | 1/1941 | Smith et al. | 75/124 |
| 3,259,487 | 7/1966 | Mueller et al. | 75/124 |
| 3,726,724 | 4/1973 | Davies | 75/124 |
| 3,990,887 | 11/1976 | Hisada | 75/124 |
| 4,123,296 | 10/1978 | Yamakoshi et al. | 148/12 B |

FOREIGN PATENT DOCUMENTS

| | | | |
|---|---|---|---|
| 41-15212 | 10/1966 | Japan | 148/36 |
| 46-37255 | 11/1971 | Japan | 148/36 |

*Primary Examiner*—M. J. Andrews

*Attorney, Agent, or Firm*—Cushman, Darby & Cushman

[57] ABSTRACT

A valve spring wire having superior fatigue and relaxation properties is disclosed, comprising, in addition to iron, manganese and silicon, together with aluminum and nitrogen for obtaining a fine-grain effect.

4 Claims, 5 Drawing Figures

INITIAL STRESS
N/mm²

950
900
850
800
750
700
650
600
930 N/mm²
Cr-Si
INVENTION
Cr-V
UNALLOYED
0 1 2 3 4 5 6 7 8 9 10 11 12 13 14
LOAD LOSS
%

LOW-ALLOYED STEEL FOR THE PREPARATION OF VALVE SPRING WIRE

This is a continuation, of application Ser. No. 835,281 filed Sept. 20, 1977, now abandoned.

This invention relates to the use of a low-alloyed steel for the preparation of valve spring wire with good fatigue and relaxation properties, as well as to the wire prepared in this way.

Valve springs must operate under fatigue conditions.

Thus, it is desirable to employ steels for the manufacture of such valve spring wires which exhibit good fatigue properties, as well as good relaxation properties, i.e. the ability of resisting plastic deformation in use.

Various steels have been used in the prior art, including specific steels of chromium and vanadium, which did exhibit improved properties over prior art valve spring wires.

However, further improvements in chromium and vanadium steels by increasing said alloy substances has been difficult due to the facts that Cr increases the sensitivity to crack formation and consequently reduces the fatigue strength, and that V and Cr are relatively expensive alloy elements.

Beside the above-mentioned steels, a steel alloyed with Cr and Si has been used, e.g. about 0.7% Cr and 1.5% Si. It is true that a steel alloy with Cr and Si results in an improved relaxation properties in compared to said Cr-V-steels, but with a simultaneous deterioration of the fatigue properties. Further development along this line, i.e. simultaneous improvement of both these properties, has been made more difficult due to the fact that Si and, as mentioned before, also Cr increase the sensitivity to crack formation. The development of such materials has remained static for the last 15 years.

Through the present invention, a considerable improvement in both the fatigue as well as the relaxation properties in comparison with the results so far obtained is achieved, and moreover, cheaper alloy substances than those so far employed are used.

According to the invention, a low-alloyed steel of the following composition is used for the preparation of valve spring wire with simultaneously good fatigue and relaxation properties, all expressed in weight percent:

| | |
|---|---|
| C | 0.5–1.0% |
| Si | 0.1–1.5% |
| Mn | 1.0–2.0% |
| $Al_{tot}$ | 0.01–0.05% |
| N | 0.004–0.020% |

The remainder being iron and normally occurring impurities.

According to a preferred embodiment of the invention the steel has the following composition, expressed in weight percent:

| | |
|---|---|
| C | 0.6–0.8% |
| Si | 0.1–1.0% |
| Mn | 1.0–2.0% |
| $Al_{tot}$ | 0.01–0.05% |
| N | 0.004–0.020% |

where the remainder likewise is iron and normally occurring impurities.

Thus, in order to achieve a simultaneous improvement of both these properties, which is a necessary combination for the spring materials in question, an increase of the Mn content and a simultaneous addition of Al and N for achieving a fine-grain effect have been used. In comparison with alloyed steels so far used a considerable improvement of the fatigue properties has been achieved with an insignificant deterioration of the relaxation properties in comparison with the Cr-Si steel. Moreover, this effect has been found to remain up to a temperature of 120° C., which is of the utmost importance because of the field of application for these material, i.e. internal combustion engines.

Thus, through an increase of the Mn content and a simultaneous use of the associated positive effect on the deformation hardening, which can be used in the blasting which is conventional in the preparation of these materials, and an addition of Al and N suitable for a fine-grain treatment, a considerable improvement has been achieved not only in the fatigue strength but also in the relaxation properties of the best of the steels mentioned above, the Cr-V steel, even at the temperatures up to 120° C., which are of special interest in this field of use. This combination effect must be considered to be completely surprising in the use of a material in accordance with this invention, and is of the greatest importance for the preparation of above all lighter valve springs.

Steels with similar contents of C, Si and Mn have previously been known for use predominantly as constructional and tool steels. However, there has been no suggestion of using such steels for such special fields of use as valve spring wire, and especially there has been no suggestion of fine grain treating the steel by addition of Al and N or with other additives.

The invention and its advantages are illustrated more in detail in the accompanying drawings. In the drawings, FIG. 1 shows the way of operation of a diagram for springs operating under fatigue conditions, and how an improved fatigue limit acts.

The invention will now be described more closely in connection with the following example.

A charge of about 42 tons has been prepared from the steel according to the invention. In addition to iron, the charge has the following chemical composition expressed in % by weight:

| % C | % Si | % Mn | % P | % S | % Cr | % Ni | % Mo | % Al | % N |
|---|---|---|---|---|---|---|---|---|---|
| 0.64 | 0.29 | 1.32 | 0.020 | 0.019 | 0.17 | 0.03 | 0.01 | 0.035 | 0.0087 |

About 22 tons of the charge were hot-rolled to wire of a diameter of 7,10 mm. This wire was cold-drawn to i.a.

a diameter of 3.80 mm, after which the wire was oil hardened and tempered.

Mechanical testing of the wire has given the following results:

| Tensile strength $R_m$ N/mm² | Yield strength $R_pO,2$ N/mm² | Contraction C % | Torsion l = 250 mm | Bending 180° r = 5 mm |
|---|---|---|---|---|
| 1646 | 1588 | 50 | 9 | 3 |

Of this wire test springs with the following spring data have been coiled:

Wire diameter, $d=\phi$ 3.80 mm

Outer diameter of the spring, $D_y=\phi$ 26.5 mm

Total number of spring coils, $n_t=7.5$ coils

Free spring length, $L_o=61$ mm

After coiling the springs were stress relieved for 30 min at 400° C.

A number of springs were cold set (20° C.) for 5 seconds once to 1100 N/mm², after which they were relaxation tested at the temperature of 80° C. The results are reported in FIG. 3 and refer to 30 hours of testing in (not shot-peened) state. Furthermore, fatigue testing has been carried out for a number of springs with $15 \cdot 10^6$ load cycles and in a shot-peened state. Shot-peening has been carried out with $\phi$ 0.80 mm shot to an intensity corresponding to an Almen value of 0.48 mm. After the shot-peening the springs have been stress relieved for 30 min at 250° C. All the springs have also been hot set to 1200 N/mm² for 5 seconds at 250° C. The results are reported in FIG. 4.

Figure 1:
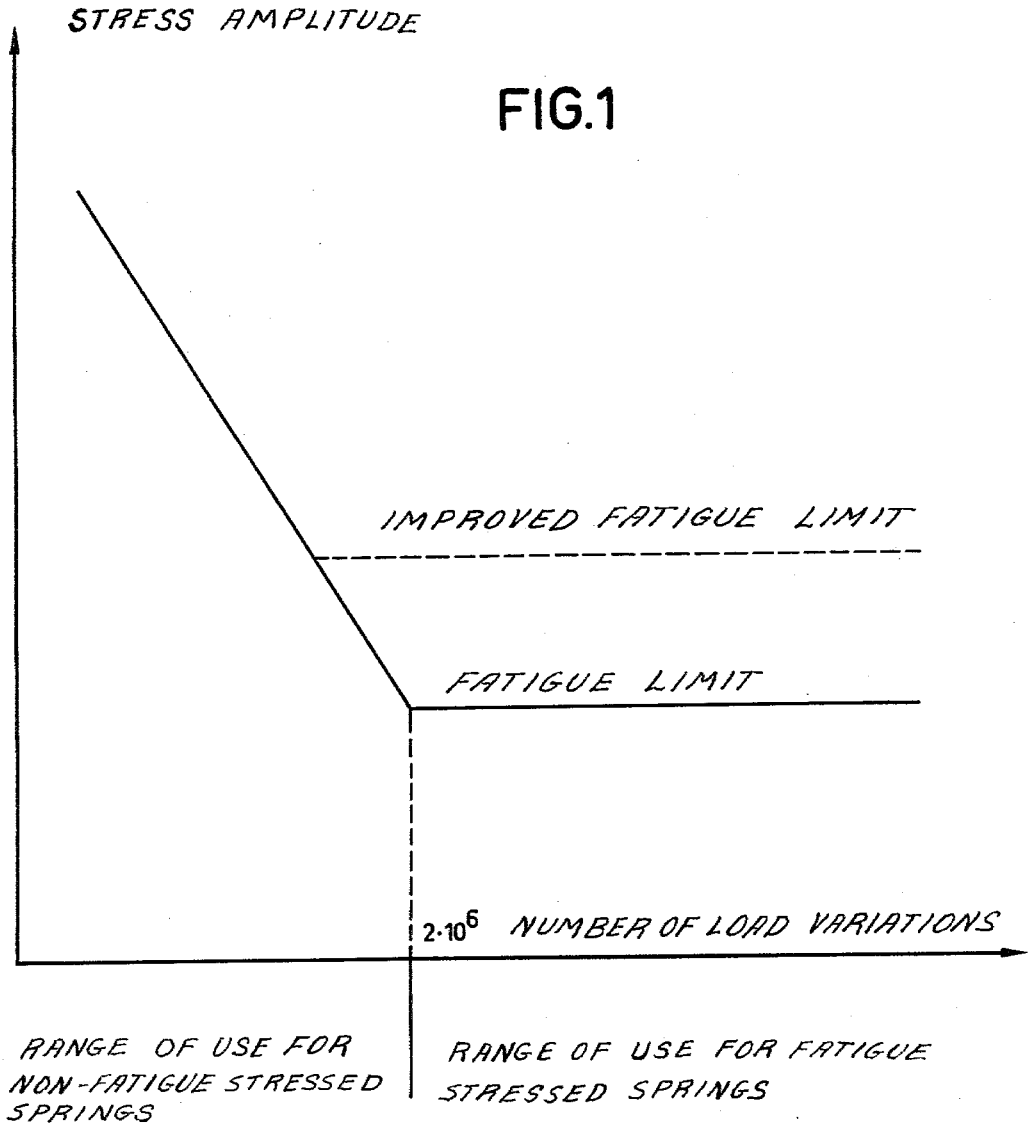
Figure 2:
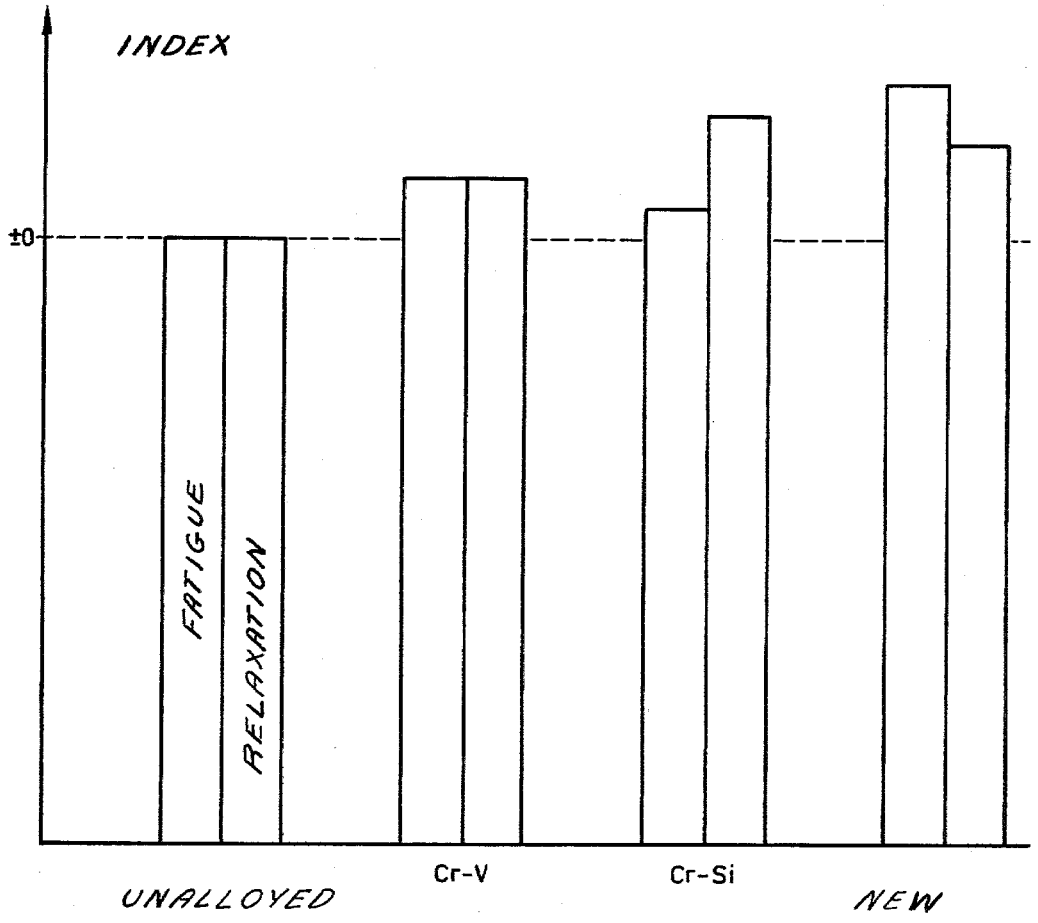
FIG. 2 shows of a diagram the differences as to fatigue and relaxation properties of previously used types of steel and that used according to the invention.
Figure 3:
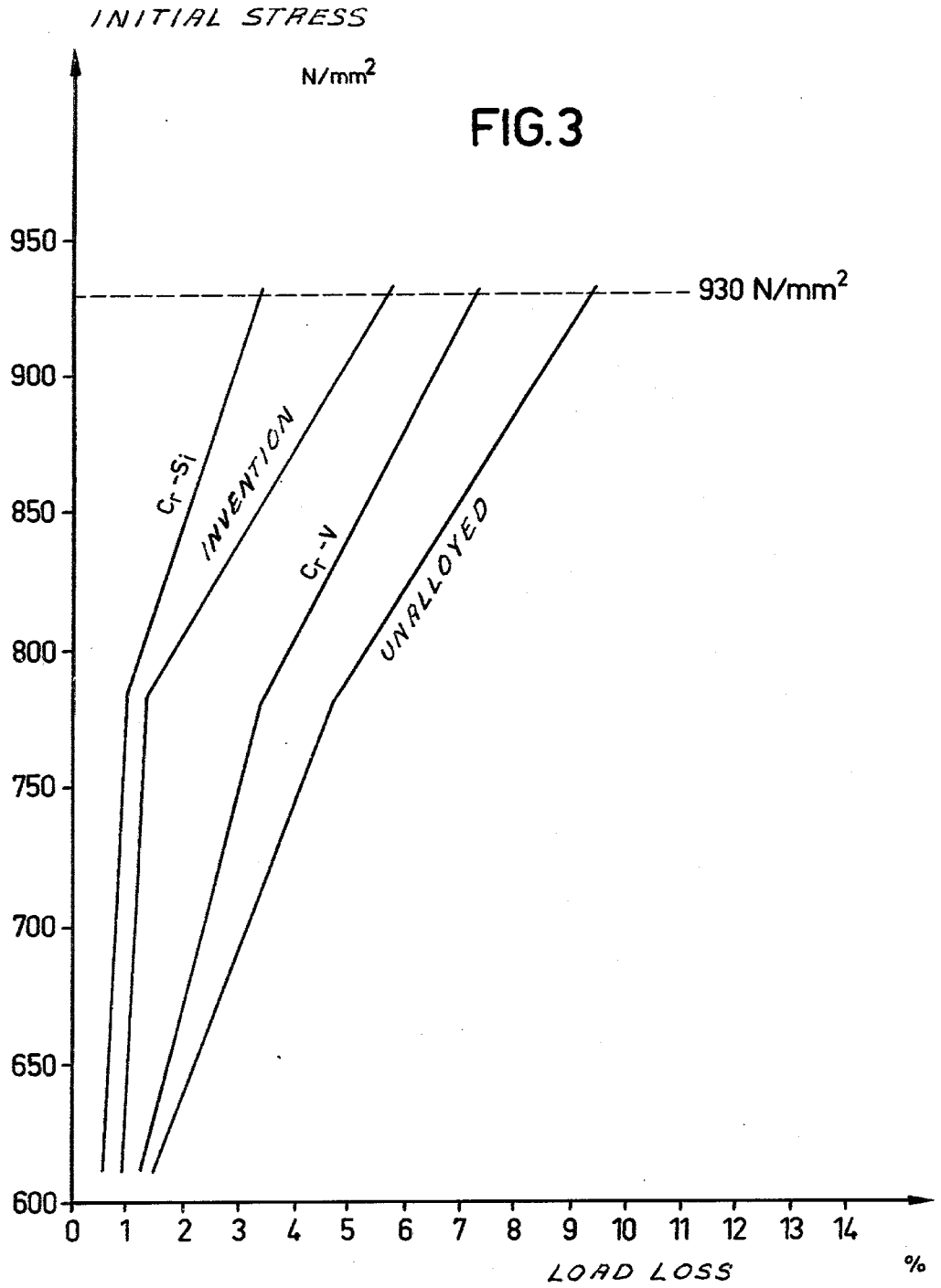
FIG. 3 shows the result of a comparative testing of the relaxation properties of springs according to the invention and such prepared from previously used materials.
Figure 4:
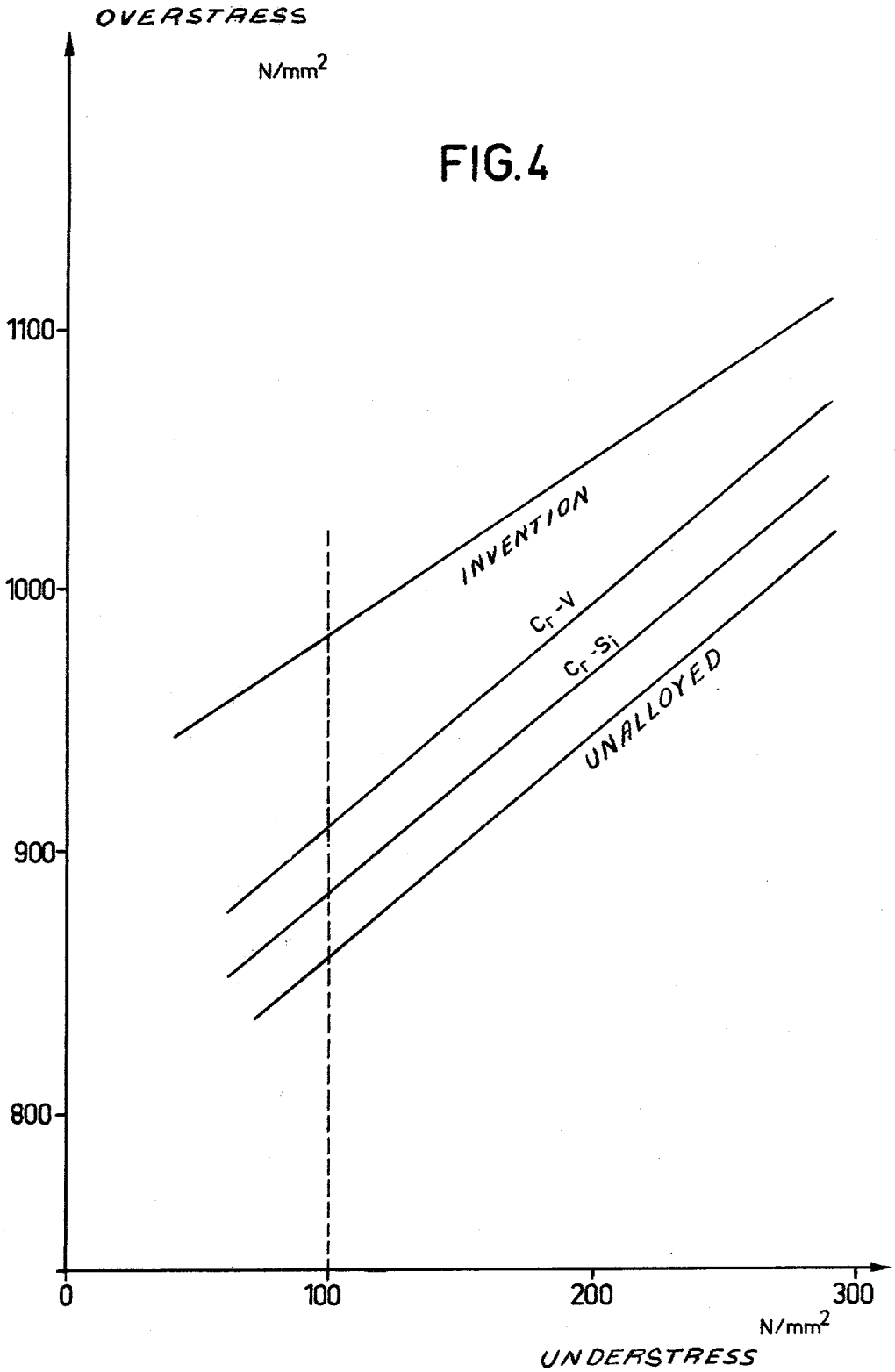
FIG. 4 shows the results of the corresponding tests of the fatigue properties.

Furthermore, in FIGS. 3 and 4 the corresponding curves for the above-mentioned steel qualities so far available (nonalloyed, Cr-V, Cr-Si) have also been inserted. The comparison between said different steel qualities expressed in FIG. 2 has, as regards the relaxation properties, been carried out at an initial stress of 930 N/mm² according to FIG. 3.

As to the fatigue properties the same comparison has been carried out in the normal manner at an initial stress of 100 N/mm² according to FIG. 4.

Figure 5:
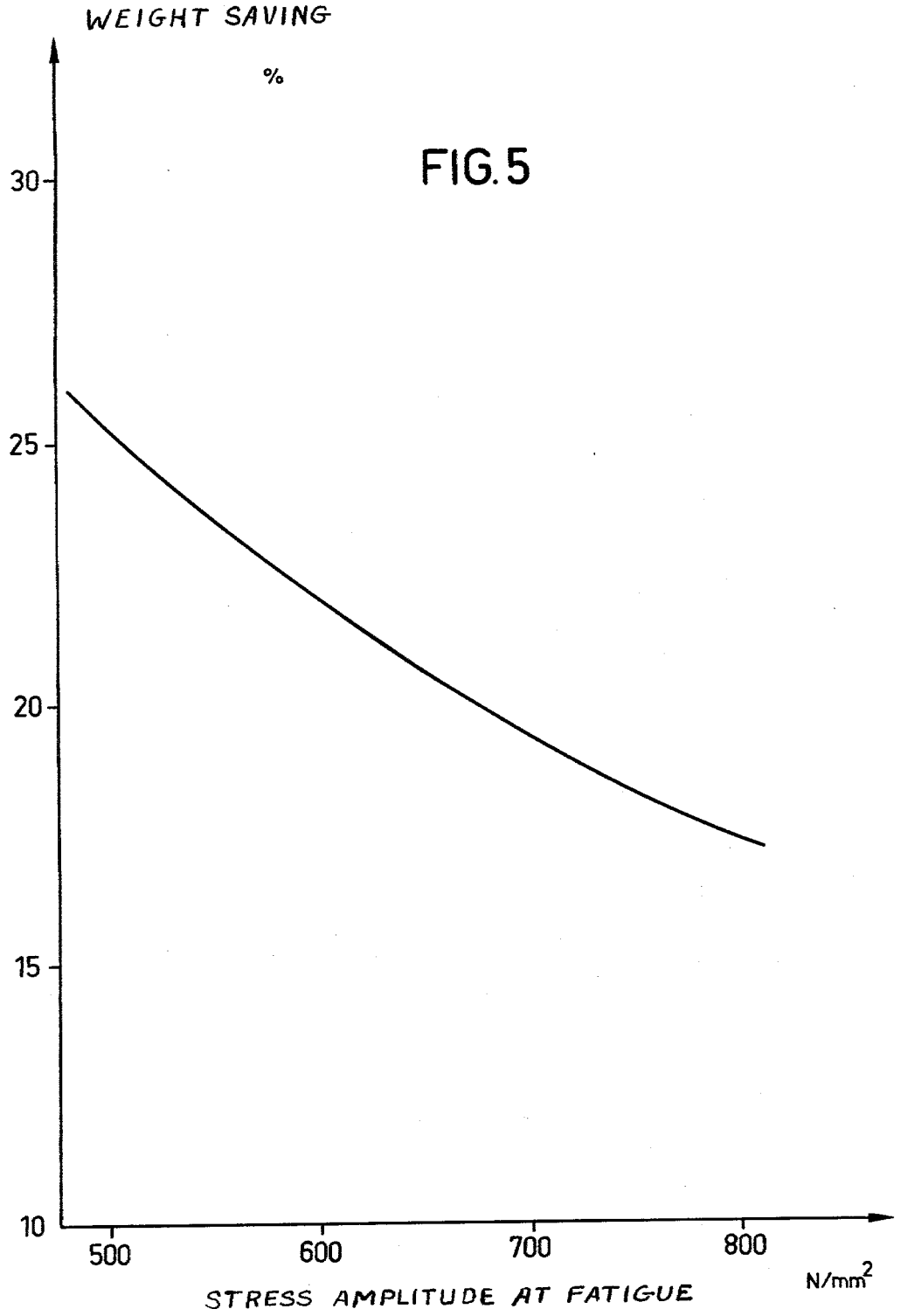
FIG. 5 shows in the form of a diagram the weight saving that can be obtained for a given stress amplitude, using valve springs prepared according to the present invention.

The weight saving mentioned above, which is exclusively dependent on the fatigue strength and which can be achieved in a spring according to the above-mentioned data by a change from a Cr-V steel to a material according to the invention, is apparent from FIG. 5 as a function of the operating stress amplitude. The reduction of wire diameter and number of active coils made possible by said material change will provide the weight saving while the other spring data are assumed to be unchanged.

What I claim is:

1. Valve spring wire of low-alloyed steel, characterized in that the wire has been oil hardened and tempered and in that the steel consists essentially of the following composition, expressed in weight percent:

| | | |
|---|---|---|
| C | 0.5 | 1.0% |
| Si | 0.1 | 1.5% |
| Mn | 1.0 | 2.0% |
| $Al_{tot}$ | 0.01 | 0.05% |
| N | 0.004 | 0.020% |

the remainder being iron as well as normally occuring impurities.

2. Valve spring wire according to claim 1, characterized in that the steel consists essentially of the following composition expressed in % by weight:

| | |
|---|---|
| C | 0.6–0.8% |
| Si | 0.1–1.0% |
| Mn | 1.0–2.0% |
| $Al_{tot}$ | 0.01–0.05% |
| N | 0.004–0.020% |

the remainder being iron as well as normally occurring impurities.

3. A valve spring for internal combustion engines made of valve spring wire of low-alloyed steel, characterized in that the wire has been oil hardened and tempered and in that the steel consists essentially of the following composition expressed in weight percent:

| | |
|---|---|
| C | 0.5–1.0% |
| Si | 0.1–1.5% |
| Mn | 1.0–2.0% |
| $Al_{tot}$ | 0.01–0.05% |
| N | 0.004–0.020% |

the remainder being iron as well as normally occurring impurities.

4. A valve spring as in claim 3, characterized in that the steel consists essentially of the following composition expressed in % by weight:

| | |
|---|---|
| C | 0.6–0.8% |
| Si | 0.1–1.0% |
| Mn | 1.0–2.0% |
| $Al_{tot}$ | 0.01–0.05% |
| N | 0.004–0.020% |

the remainder being iron as well as normally occurring impurities.

* * * * *